US007921828B2

(12) United States Patent
Knafl et al.

(10) Patent No.: US 7,921,828 B2
(45) Date of Patent: Apr. 12, 2011

(54) MODULATING FLOW THROUGH AN EXHAUST GAS RECIRCULATION COOLER TO MAINTAIN GAS FLOW VELOCITIES CONDUCIVE TO REDUCING DEPOSIT BUILD-UPS

(75) Inventors: Alexander Knafl, Royal Oak, MI (US); Patrick G. Szymkowicz, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 455 days.

(21) Appl. No.: 12/052,105

(22) Filed: Mar. 20, 2008

(65) Prior Publication Data

US 2009/0235662 A1 Sep. 24, 2009

(51) Int. Cl.
*F02B 47/08* (2006.01)
*F02B 47/00* (2006.01)

(52) U.S. Cl. ..... 123/568.12

(58) Field of Classification Search ..... 123/568.12, 123/568.11, 540, 547; 701/108; 60/605.2, 60/324

See application file for complete search history.

(56) References Cited

U.S. PATENT DOCUMENTS

| | | | | |
|---|---|---|---|---|
| 4,593,749 | A * | 6/1986 | Schatz | 165/283 |
| 6,820,682 | B2 * | 11/2004 | Hayashi et al. | 165/52 |
| 6,898,930 | B2 * | 5/2005 | Nakatani et al. | 60/311 |
| 2002/0074105 | A1 * | 6/2002 | Hayashi et al. | 165/43 |
| 2007/0131207 | A1 | 6/2007 | Nakamura | |

FOREIGN PATENT DOCUMENTS

| | | | |
|---|---|---|---|
| JP | 2001173519 | A | 6/2001 |
| JP | 2003004389 | A | 1/2003 |
| JP | 2003227691 | A | 8/2003 |

* cited by examiner

*Primary Examiner* — Mahmoud Gimie

(57) ABSTRACT

A heat exchanger of motor vehicle processes a gas flow including combustion exhaust gas. Combustion by-product deposit build-up within the heat exchanger is reduced by maintaining a minimum gas flow velocity within the heat exchanger by reducing heat exchanger total gas flow cross section to locally increase a gas flow velocity.

18 Claims, 7 Drawing Sheets

MODULATING FLOW THROUGH AN EXHAUST GAS RECIRCULATION COOLER TO MAINTAIN GAS FLOW VELOCITIES CONDUCIVE TO REDUCING DEPOSIT BUILD-UPS

TECHNICAL FIELD

This disclosure is related to exhaust gas recirculation circuits in internal combustion engine applications.

BACKGROUND

Exhaust gas recirculation (EGR) circuits are known in the art as a method to modulate a combustion reaction within an internal combustion engine. Such EGR circuits remove a portion of exhaust gas flow from the exhaust system. Exhaust systems transport combustion by-products in the form of exhaust gas flow from the engine through various treatment devices and out of the vehicle through a tailpipe. EGR circuits channel a portion of exhaust gas flow back to an input flow to reenter the combustion chambers within cylinders of the engine. In such an application, the exhaust gas flow, when mixed with the fuel air charge within the combustion chamber, acts as an inert gas, changing the properties of combustion within the chamber. The effects associated with the use of EGR, for example, the reduction of NOx emissions, are known in the art. EGR circuits are known for use in many different engine types and configurations, for instance in both diesel and gasoline engines.

Combustion, the process by which a fuel air charge is ignited and utilized to create work in a combustion chamber, is highly dependent upon the conditions existing within the combustion chamber. Variations in properties such as temperature within the combustion chamber can cause adverse effects upon the resulting combustion. The temperature of the EGR flow channeled into the combustion chamber has effects upon the overall temperature within the combustion chamber. As a result of the need to control these temperatures, methods are known to modulate the temperature of EGR flow within the EGR circuit through the use of an EGR cooler comprising a heat exchange device.

Heat exchange devices can take many forms. One known heat exchange device is a gas to liquid type heat exchanger, wherein a gas flow is passed through a plurality of gas flow passages defined by walls within the heat exchanger, and wherein a liquid flow is passed through a plurality of liquid flow passages defined by walls within the heat exchanger. One known liquid used to cool the EGR flow within the heat exchanger is engine coolant, frequently in communication with the engine cooling system; however, it will be appreciated many different liquids, either as part of an existing liquid circuit in the vehicle or as a dedicated circuit for use by the EGR cooler, can be used for the heat exchanger. Another known heat exchange device is a gas to gas type heat exchanger, wherein a first gas flow is passed through a plurality of gas flow passages defined by walls within the heat exchanger, and wherein a second gas flow is passed through a second plurality of gas flow passages defined by walls within the heat exchanger. An air flow channeled from outside the vehicle through the heat exchanger is frequently used as a cooling gas flow, although it will be appreciated many different gases, either as part of an existing liquid circuit in the vehicle or as a dedicated circuit for use by the EGR cooler, can be used for the heat exchanger. Additionally, multiple stage EGR coolers are known, wherein the EGR flow is passed through a plurality of heat exchangers in series, the first heat exchanger cooling the EGR flow to some intermediate temperature and the second heat exchanger cooling the EGR flow to some cooler temperature. Alternatively or additionally, heat exchangers can be utilized in parallel, with the EGR flow being directed between one path or the other, with each path containing a single heat exchanger or multiple heat exchangers in series. In such multiple stage EGR coolers, different types of heat exchangers or different cooling mediums can be utilized. Also, in some circumstances, the EGR cooler can actually be used to impart heat to the EGR flow from another medium to the EGR flow, for instance, in an engine warm-up condition. The walls within the heat exchanger defining the gas flow passages for the EGR flow are frequently the same piece of material as the walls within the heat exchanger defining the flow passages for the second flow, where the flows are in contact with opposite sides of the piece of material. By utilizing such designs, flows of two distinct materials flowing on either side of the walls can cause heat to transfer from a flow with a higher temperature to a flow with a lower temperature through the separating piece of material. Design of heat exchangers, including design of walls within the heat exchanger, choice of materials or coatings for the walls in the heat exchanger, use and design of fins within the passages to increase surface area within the heat exchanger, and other considerations are known in the art and will not be discussed herein. Additionally, heat exchangers are known in a wide variety of configurations, for example including parallel-flow, cross-flow, and counter-flow, and many interior designs of heat exchanger are known, for example wherein the liquid flow can be passed through the heat exchanger in a single pass or partitions may be used to make the liquid travel through the heat exchanger in multiple passes. Although exemplary forms of heat exchangers are described and illustrated herein, heat exchangers can take many forms and alternative embodiments, and the methods described herein are not intended to be limited to the specific embodiments described. For the purposes of this disclosure, in order to affect effective heat transfer within the heat exchanger, heat exchanger design for use in an EGR cooler requires a gas flow to go through flow passages designed to maximize the surface area through which heat can transfer between the different medium flows.

EGR flows, the exhaust gas flow tapped from the exhaust system for the purposes of controlling combustion within the combustion chamber as described above, contain by-products of combustion. Particulate matter (PM) and other combustion by-products travel through the exhaust system with the exhaust gas flow. The EGR circuit, by tapping into the exhaust system, is exposed to these by-products. As described above, heat exchanger design includes the creation of narrow and subdivided passages in order to maximize heat transfer from the hot gas to the cooling liquid. However, narrow passages with large surface areas can act as filters to the combustion by-products, collecting particulate deposits on the surfaces within the passages. Such deposits within the heat exchanger can have a number of adverse effects upon the heat exchanger, including but not limited to corrosion, increased flow resistance, flow blockage, reduction of heat transfer capacity, and NVH.

A method to reduce the build-up of deposits within an EGR cooler would result in increased performance of the heat exchanger and less frequent maintenance issues for the heat exchanger.

SUMMARY

A heat exchanger of motor vehicle processes a gas flow including combustion exhaust gas. Combustion by-product deposit build-up within the heat exchanger is reduced by maintaining a minimum gas flow velocity within the heat exchanger by reducing heat exchanger total gas flow cross section to locally increase a gas flow velocity.

BRIEF DESCRIPTION OF THE DRAWINGS

One or more embodiments will now be described, by way of example, with reference to the accompanying drawings, in which.

DETAILED DESCRIPTION

Figure 1:
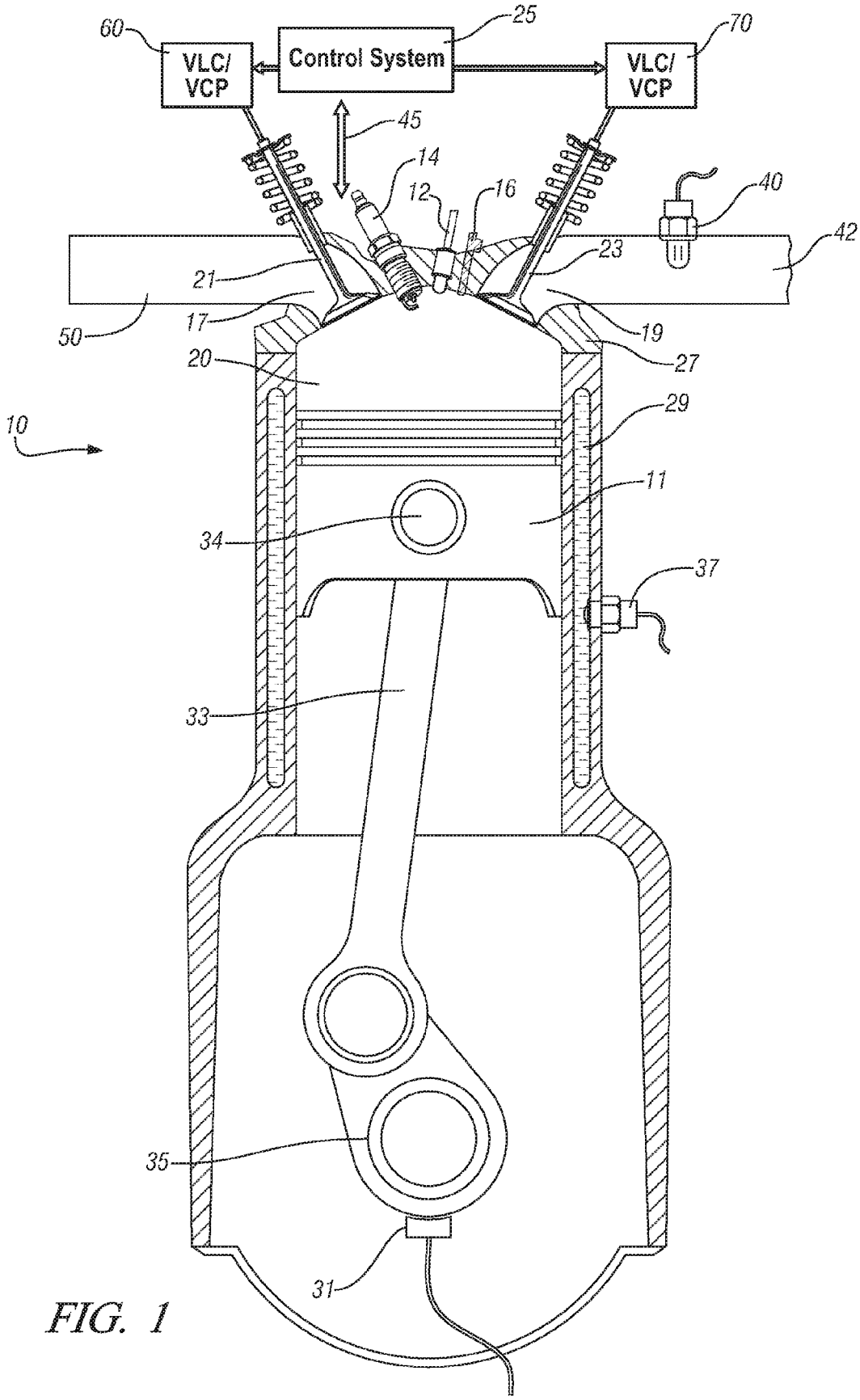
FIG. 1 depicts a schematic of an internal combustion engine and control system which has been constructed in accordance with the present disclosure.

Referring now to the drawings, wherein the showings are for the purpose of illustrating certain exemplary embodiments only and not for the purpose of limiting the same, FIG. 1 shows a schematic of an internal combustion engine 10 and control system 25 which has been constructed in accordance with an embodiment of the present disclosure. The embodiment as shown is applied as part of an overall control scheme to operate an exemplary multi-cylinder, spark ignition, direct-injection, gasoline, four-stroke internal combustion engine. However, as will be appreciated by one having ordinary skill in the art, the methods described herein can be utilized on many and various engine configurations, and the exemplary engine design depicted in FIG. 1 is meant for purposes of illustration only.

The exemplary engine 10 includes a cast-metal engine block with a plurality of cylinders formed therein, one of which is shown, and an engine head 27. Each cylinder comprises a closed-end cylinder having a moveable, reciprocating piston 11 inserted therein. A variable volume combustion chamber 20 is formed in each cylinder, and is defined by walls of the cylinder, the moveable piston 11, and the head 27. The engine block preferably includes coolant passages 29 through which engine coolant fluid passes. A coolant temperature sensor 37, operable to monitor temperature of the coolant fluid, is located at an appropriate location, and provides a parametric signal input to the control system 25 useable to control the engine. The engine preferably includes known systems including an external exhaust gas recirculation ('EGR') valve and an intake air throttle valve (not shown).

Each moveable piston 11 comprises a device designed in accordance with known piston forming methods, and includes a top and a body which conforms substantially to the cylinder in which it operates. The piston has top or crown area that is exposed in the combustion chamber. Each piston is connected via a pin 34 and connecting rod 33 to a crankshaft 35. The crankshaft 35 is rotatably attached to the engine block at a main bearing area near a bottom portion of the engine block, such that the crankshaft is able to rotate around an axis that is perpendicular to a longitudinal axis defined by each cylinder. A crank sensor 31 is placed in an appropriate location, operable to generate a signal that is useable by the controller 25 to measure crank angle, and which is translatable to provide measures of crankshaft rotation, speed, and acceleration that are useable in various control schemes. During operation of the engine, each piston 11 moves up and down in the cylinder in a reciprocating fashion due to connection to and rotation of the crankshaft 35, and the combustion process. The rotation action of the crankshaft effects translation of linear force exerted on each piston during combustion to an angular torque output from the crankshaft, which can be transmitted to another device, e.g. a vehicle driveline.

The engine head 27 comprises a cast-metal device having one or more intake ports 17 and one or more exhaust ports 19 which flow to the combustion chamber 20. The intake port 17 supplies air to the combustion chamber 20. Combusted (burned) gases flow from the combustion chamber 20 via exhaust port 19. Flow of air through each intake port is controlled by actuation of one or more intake valves 21. Flow of combusted gases through each exhaust port is controlled by actuation of one or more exhaust valves 23.

The intake and exhaust valves 21, 23 each have a head portion that includes a top portion that is exposed to the combustion chamber. Each of the valves 21, 23 has a stem that is connected to a valve actuation device. A valve actuation device, depicted as 60, is operative to control opening and closing of each of the intake valves 21, and a second valve actuation device 70 operative to control opening and closing of each of the exhaust valves 23. Each of the valve actuation devices 60, 70 comprises a device signally connected to the control system 25 and operative to control timing, duration, and magnitude of opening and closing of each valve, either in concert or individually. The first embodiment of the exemplary engine comprises a dual overhead cam system which has variable lift control ('VLC') and variable cam phasing ('VCP'). The VCP device is operative to control timing of opening or closing of each intake valve and each exhaust valve relative to rotational position of the crankshaft and opens each valve for a fixed crank angle duration. Exemplary VCP devices include known cam phasers. The exemplary VLC device is operative to control magnitude of valve lift to one of two positions: one position to 3-5 mm lift for an open duration of 120-150 crank angle degrees, and another position to 9-12 mm lift for an open duration of 220-260 crank angle degrees. Exemplary VLC devices include known two-step lift cams. Individual valve actuation devices can serve the same function to the same effect. The valve actuation devices are preferably controlled by the control system 25 according to predetermined control schemes. Alternative variable valve actuation devices including, for example, fully flexible electrical or electro-hydraulic devices may also be used and have the further benefit of independent opening and closing phase control as well as substantially infinite valve lift variability within the limits of the system. A specific aspect of a control scheme to control opening and closing of the valves is described herein. One having ordinary skill in the art will appreciate that engine valves and valve activation systems may take many forms, and the exemplary engine configuration depicted is for purposes of illustration only. Methods described herein are not intended to be limited to the particular exemplary configuration described herein.

Air is inlet to the intake port 17 through an intake manifold runner 50, which receives filtered air passing through a known air metering device and a throttle device (not shown). Exhaust gas passes from the exhaust port 19 to an exhaust manifold 42, which includes exhaust gas sensors 40 operative to monitor constituents of the exhaust gas feedstream, and determine parameters associated therewith. The exhaust gas sensors 40 can comprise any of several known sensing devices operative to provide parametric values for the exhaust gas feedstream, including air/fuel ratio, or measurement of exhaust gas constituents, e.g. NOx, CO, HC, and others. The system may include an in-cylinder sensor for monitoring combustion pressures, non-intrusive pressure sensors, or inferentially determined pressure determination (e.g. through crankshaft accelerations). The aforementioned sensors and metering devices each provide a signal as a parametric input to the control system 25. These parametric inputs can be used by the control system to determine combustion performance measurements.

The control system 25 preferably comprises a subset of an overall control architecture operable to provide coordinated system control of the engine 10 and other systems. In overall operation, the control system 25 is operable to synthesize operator inputs, ambient conditions, engine operating parameters, and combustion performance measurements, and execute algorithms to control various actuators to achieve targets for control parameters, including such parameters as fuel economy, emissions, performance, and driveability. The control system 25 is operably connected to a plurality of devices through which an operator typically controls or directs operation of the engine. Exemplary operator inputs include an accelerator pedal, a brake pedal, transmission gear selector, and vehicle speed cruise control when the engine is employed in a vehicle. The control system may communicate with other controllers, sensors, and actuators via a local area network ('LAN') bus (not shown) which preferably allows for structured communication of control parameters and commands between various controllers.

The control system 25 is operably connected to the engine 10, and functions to acquire parametric data from sensors, and control a variety of actuators of the engine 10 over appropriate interfaces 45. The control system 25 receives an engine torque command, and generates a desired torque output, based upon the operator inputs. Exemplary engine operating parameters that are sensed by control system 25 using the aforementioned sensors include engine coolant temperature, crankshaft rotational speed ('RPM') and position, manifold absolute pressure, ambient air flow and temperature, and, ambient air pressure. Combustion performance measurements typically comprise measured and inferred combustion parameters, including air/fuel ratio, location of peak combustion pressure, among others.

Actuators controlled by the control system 25 include: fuel injectors 12; the VCP/VLC valve actuation devices 60, 70; spark plug 14 operably connected to ignition modules for controlling spark dwell and timing; exhaust gas recirculation (EGR) valve (not shown), and, electronic throttle control module (not shown), and water injector 16. Fuel injector 12 is preferably operable to inject fuel directly into each combustion chamber 20. Specific details of exemplary direct injection fuel injectors are known and not detailed herein. Spark plug 14 is employed by the control system 25 to enhance ignition timing control of the exemplary engine across portions of the engine speed and load operating range. When the exemplary engine is operated in an auto-ignition mode, the engine does not utilize an energized spark plug. It has proven desirable to employ spark ignition to complement auto-ignition modes under certain conditions, including, e.g. during cold start, at low load operating conditions near a low-load limit, and to prevent fouling. Also, it has proven preferable to employ spark ignition at a high load operation limit in auto-ignition modes, and at high speed/load operating conditions under throttled or un-throttled spark-ignition operation.

The control system 25 preferably comprises a general-purpose digital computer generally comprising a microprocessor or central processing unit, read only memory (ROM), random access memory (RAM), electrically programmable read only memory (EPROM), high speed clock, analog to digital (A/D) and digital to analog (D/A) circuitry, and input/output circuitry and devices (I/O) and appropriate signal conditioning and buffer circuitry. Each controller has a set of control algorithms, comprising resident program instructions and calibrations stored in ROM and executed to provide the respective functions of each computer.

Algorithms for engine control are typically executed during preset loop cycles such that each algorithm is executed at least once each loop cycle. Algorithms stored in the non-volatile memory devices are executed by the central processing unit and are operable to monitor inputs from the sensing devices and execute control and diagnostic routines to control operation of the engine, using preset calibrations. Loop cycles are typically executed at regular intervals, for example each 3.125, 6.25, 12.5, 25 and 100 milliseconds during ongoing engine operation. Alternatively, algorithms may be executed in response to occurrence of an event or interrupt request.

As aforementioned, EGR circuits are used in a wide variety of engine types and engine designs. FIG. 1 depicts an exemplary engine capable of utilizing an EGR circuit. The fuel air mixture utilized to power engine 10 may include gasoline or gasoline blends, but the mixture may also comprise other flexible fuel types, such as ethanol or ethanol blends such as the fuel commonly known as E85. Different engine configurations are known to utilize other fuels such as diesel fuel or diesel blends and utilize EGR circuits. The methods described do not depend upon the particular variety of fuel used and are not intended to be limited to the embodiments disclosed herein.

Figure 2:
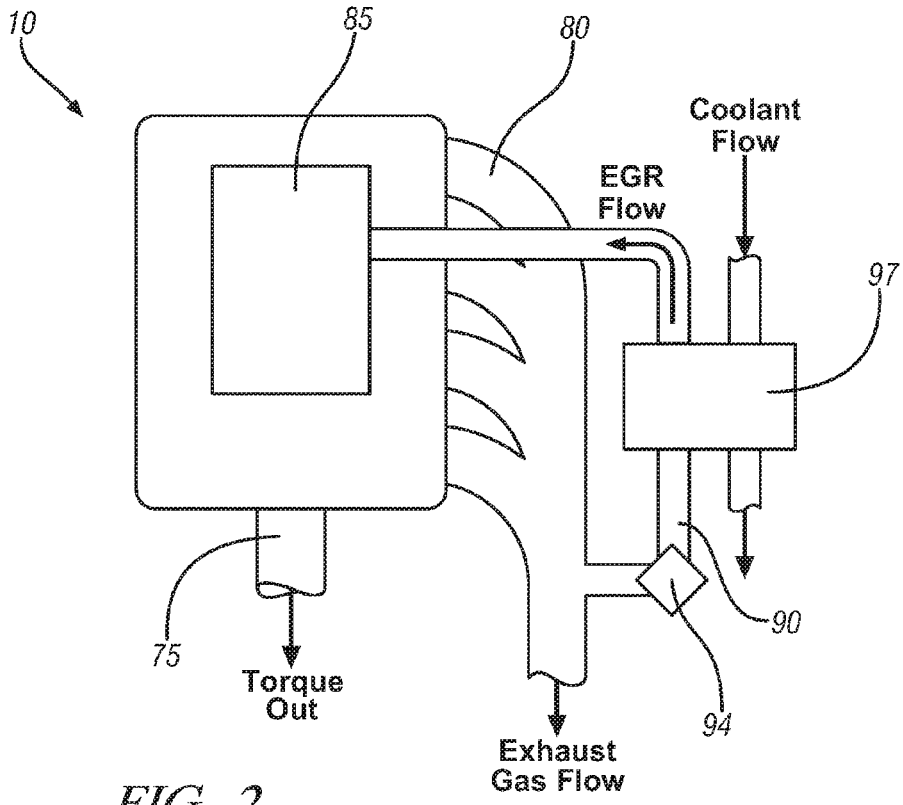
FIG. 2 depicts a schematic of an engine utilizing an EGR circuit including an EGR cooler in accordance with the present disclosure.

FIG. 2 schematically illustrates an exemplary engine configuration utilizing an EGR circuit in accordance with the present disclosure. Engine 10 is depicted including an output shaft 75, an exhaust system 80, an intake manifold 85, and an EGR circuit 90. Engine 10 receives at least the air portion of the fuel air mixture necessary for combustion through the intake manifold 85, performs the combustion process within combustion chambers within engine 10, supplies a torque to output shaft 75, and emits an exhaust gas flow which exits engine 10 through exhaust system 80. EGR circuit 90 is communicably attached to exhaust system 80 and is depicted including an EGR valve 94 and an EGR cooler 97. EGR valve 94 is actuated by control system 25. Various control methodologies for activating the EGR valve under particular operating conditions are known in the art and will not be described in detail herein. EGR valve 94, when controlled to an off position, blocks any exhaust gas flow from exhaust system 80, the flow under a pressure gradient from the combustion process, from entering EGR circuit 90. EGR valve 94, when controlled to an on or open position, opens, and EGR circuit 90 can then utilize pressure and velocity of the exhaust gas flow to channel a portion of the exhaust gas flow into EGR circuit 90 as an EGR flow. EGR valve 94, in some embodiments, is capable of opening partially, thereby modulating the amount of exhaust gas diverted into an EGR flow. The EGR flow travels through EGR circuit 90 to intake manifold 85, where it is combined with at least the air portion of the fuel air mixture in order to derive the combustion control properties enabled by the use of an EGR as described above. As described above, the combustion process within engine 10 is sensitive to conditions such as the temperature within the combustion chamber during combustion. EGR flow taken from a high temperature exhaust gas flow can increase the temperature within the combustion chamber to undesirable levels. Therefore, it is known to utilize EGR cooler 97 to remove heat from the EGR flow, thereby controlling the resulting temperature of the EGR flow eventually entering the combustion chamber.

Various methods are known to reduce the temperature of a gas flow within a heat exchanger. Gas to gas heat exchangers are utilized to transfer heat from one gas flow to another. Gas to liquid heat exchangers are utilized to transfer heat from a gas to a liquid. As mentioned above, different gas or liquid mediums can be used to transfer heat to or from the gas flow. In any heat exchanger processing a gas flow, the gas flow enters the heat exchanger through gas flow passages, undergoes heat transfer with another medium, and exits the heat exchanger with a temperature change resulting from the heat transfer. Engines are known to utilize engine coolant liquid to cool various parts of the engine. An exemplary configuration of EGR cooler 97 is depicted in FIG. 2 as a gas to liquid heat exchanger, wherein a high temperature EGR flow passes through EGR cooler 97, transfers heat to a liquid medium in the form of an engine coolant liquid flow, the EGR flow thereafter exiting EGR cooler 97 as a reduced temperature EGR flow. Some known exemplary embodiments of EGR cooler 97 include an engine coolant control device in communication with control system 25 capable of controlling flow and amount of engine coolant liquid entering EGR cooler 97, thereby controlling the amount of heat transferred from the EGR flow and controlling the reduction in temperature of the EGR flow. Under some operating conditions and configurations, the engine coolant liquid flow can be turned off such that EGR flow is delivered to the combustion chamber at a maximum temperature.

Figure 3:
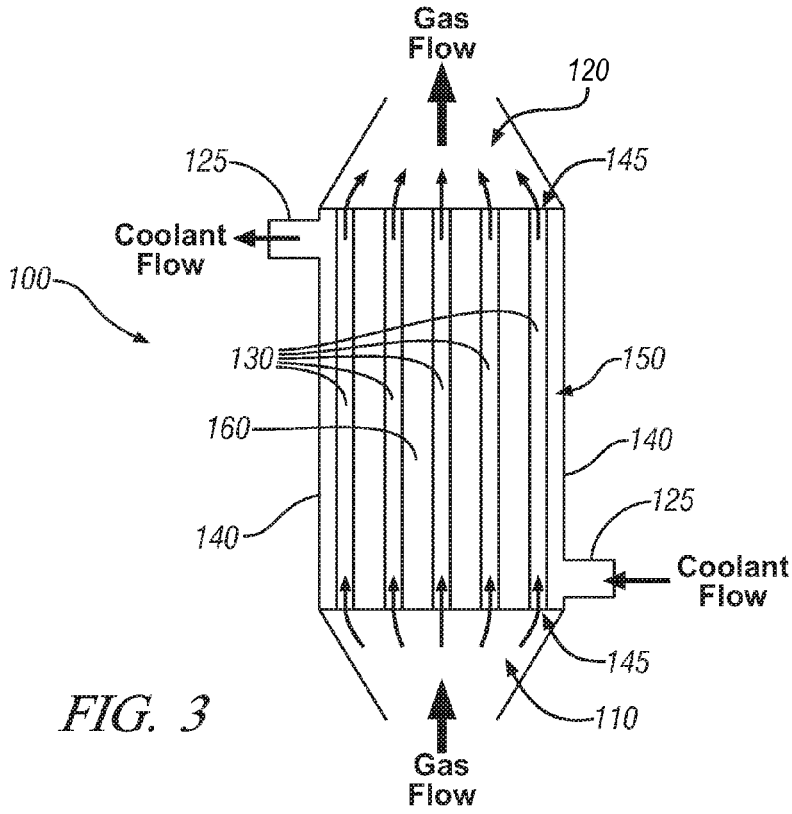
FIG. 3 depicts a sectional view of a known EGR cooler in accordance with the present disclosure.

FIG. 3 is a schematic illustration of an exemplary gas to liquid heat exchanger in accordance with the present disclosure. Heat exchangers and components thereof can be made of many materials. High temperatures exhibited within the exhaust gas flow influence the choice of materials used within heat exchangers coming into contact with the high temperature gases. In addition, corrosive combustion by-products present in the exhaust gases also influence the choice of materials used. Stainless steel is one known material used in exhaust components for its resistance to both high temperatures and corrosion. Certain other designs, wherein temperatures reaching the heat exchanger are somewhat lower and corrosive forces are mitigated, can utilize other materials such as aluminum. Other exemplary designs of heat exchangers utilize plastic or other synthetic materials, for example, to construct portions of headers or connective orifices wherein direct exposure to a higher temperature flow is not permitted. Heat exchangers are known to include various coatings to protect the structure of the heat exchanger or to impart other beneficial properties. The materials described above are given for example only. Choice of materials and coatings in particular heat exchangers are known in the art, and the materials and constructions of heat exchangers within this disclosure are not intended to be limited to the specific exemplary embodiments described herein.

Returning to FIG. 3, an exemplary gas to liquid heat exchanger 100 is depicted comprising a gas inlet section 110, a gas outlet section 120, coolant orifices 125, a bundle of gas flow tubes 130, end plates 145, and heat exchanger shell 140. As mentioned above, any heat exchanger processing a gas flow includes gas flow passages. In this embodiment, the gas flow passages take the form of tubes 130. Heat exchanger shell 140 surrounds the bundle of tubes 130 and seals with the end plate 145 to form a liquid flow container 150. End plates 145 include openings designed to accept, fix, and seal to each of the tubes 130. Tubes 130 are arranged such that gaps 160 separate tubes from each other and from the heat exchanger shell 140. Coolant enters the liquid flow container 150 through a first coolant orifice 125 and flows around and through gaps 160 and exits the liquid flow container through a second coolant orifice 125. Likewise, a gas flow enters heat exchanger 100 through gas inlet section 110, flows through gas flow tubes 130, and exits the heat exchanger through gas outlet section 120. Because gas flow tubes 130 are in direct contact with the cooler liquid coolant flow on the outside and the hotter gas flow on the inside, heat can be transferred through the walls of tube 130, cooling the gas flow and warming the liquid flow. In this way, heat exchanger 100 enables the cooling of a hot gas flow.

Figure 4:
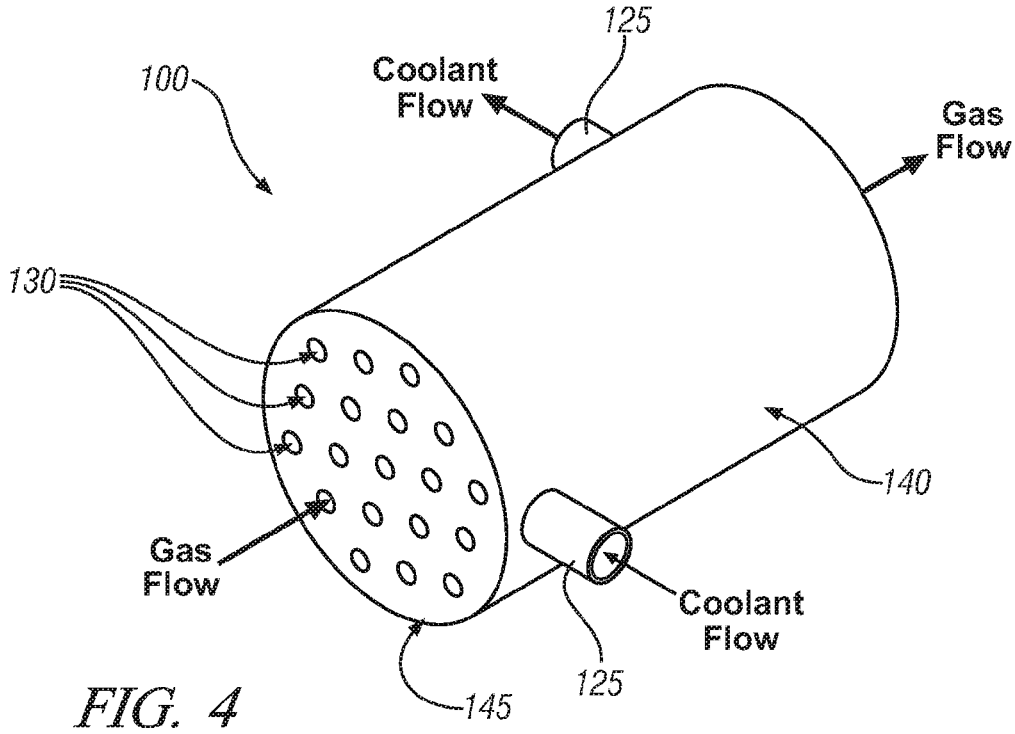
FIG. 4 illustrates a perspective view of a known heat exchanger utilized in a EGR cooler in accordance with the present disclosure.

FIG. 4 is a perspective view of a gas to liquid heat exchanger including an exemplary configuration of tubes in accordance with the disclosure. Heat exchanger 100 includes heat exchanger shell 140 and end plates 145 affixed to either end (the second end plate not shown). Tubes 130 are held in place by the two end plates 145 and run parallel to the larger cylinder created by the heat exchanger shell 140. Tubes as depicted are round in cross-section. However, it will be appreciated by one having ordinary skill in the art that tubes can be used in a wide variety of cross sectional shapes. Additionally, tubes may be hollow, with a cavity running longitudinally through the tube in the same shape as the outside of the tube, or tubes can utilize more complex shapes increasing the surface area that the gas flowing through the tube comes into contact with. Many tube designs are contemplated, and the disclosure is not intended to be limited to the exemplary embodiments described herein. Liquid coolant flow enters a first orifice 125, flows through the heat exchanger around the tubes 130, and exits the heat exchanger through a second orifice 125. Gas flow enters the heat exchanger through tubes 130, passes through the tubes, and exits the heat exchanger. Heat exchanger 100 is depicted as a cylinder shape, however it will be appreciated by one having ordinary skill in the art that heat exchanger 100 can be utilized in a number of shapes, and the disclosure is not intended to be limited to the exemplary embodiments described herein. It will also be appreciated that heat exchangers can alternatively be arranged such that the cooling medium can be made to flow through tubes, and the gas flow being cooled can be channeled through gas flow passages around the tubes containing the cooling medium. Various heat exchanger designs are contemplated, and the disclosure is not intended to be limited to the exemplary embodiments described herein.

Exemplary embodiments of an EGR cooler utilize heat exchangers to cool an EGR flow in preparation for the EGR flow being fed into a combustion chamber. As previously mentioned, EGR flow, being a diverted portion of the exhaust gas flow, contains PM and other contaminant by-products of the combustion process. Such by-products decrease the effectiveness of the EGR cooler and decrease the effective life of the EGR cooler. PM deposits left on the surfaces of the heat exchanger exposed to the gas flow act as an insulating blanket, decreasing the amount of heat that passes through the surfaces for a given temperature difference between the flow mediums. Deposits built up upon the walls of gas flow passages also decrease the effective cross sections of the gas flow passages, decreasing the flow of gas that flows through the gas flow passages for a given pressure difference across the heat exchanger. PM and other contaminants contain unburned hydrocarbons, other caustic substances, and water. Especially in the presence of elevated temperatures present in the engine compartment and the EGR flow, the deposits within the gas flow passages promote corrosion and other degradation of the EGR cooler.

Figure 5:
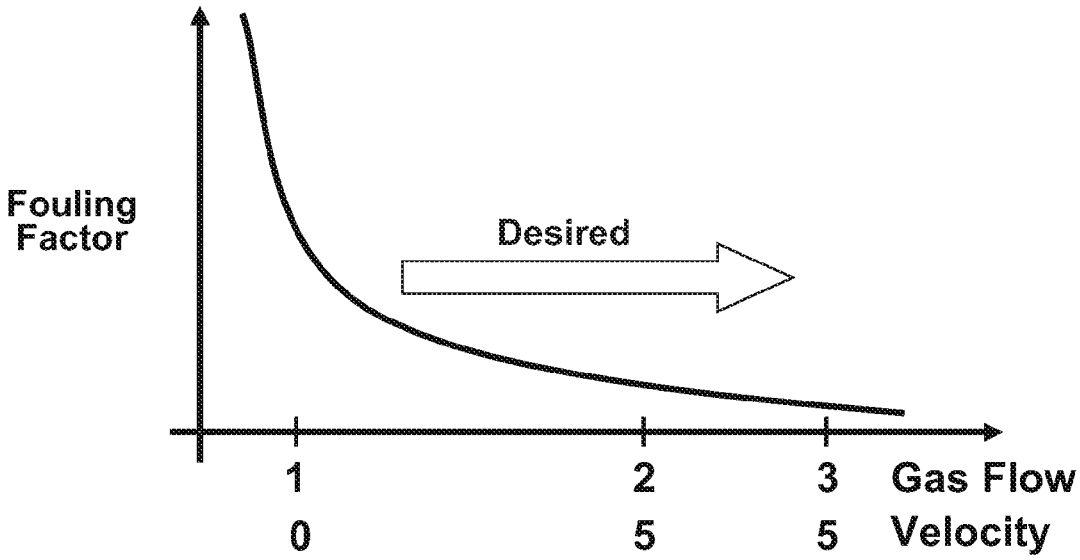
FIG. 5 is a graphical representation of fouling experienced within a device exposed to exhaust gases as a function of exhaust gas speed in accordance with the present disclosure.

Testing has shown that the rate of deposits forming or fouling of a heat exchanger exposed to exhaust gas flow such as an EGR cooler depends heavily upon the velocity of the gas flow within the heat exchanger. Gas flow rates within an EGR circuit and an associated known EGR cooler can change according to a number of parameters. For example, pressure and velocity of an exhaust gas flow within an exhaust system can change depending upon engine operation, affecting the supply of exhaust gas available at the EGR valve and, therefore, affecting the resulting pressure and velocity of the EGR flow. Additionally, as mentioned above, some exemplary EGR valves are enabled to open partially, modulating the EGR flow in relation to the available exhaust gas flow within the exhaust system. FIG. 5 graphically illustrates exemplary fouling rates as a function of gas flow velocity in accordance with the present disclosure. As demonstrated by the graph, if a relatively high minimum EGR flow velocity could be maintained, fouling of the EGR cooler could be minimized, resulting in reduced deposits within the EGR cooler and avoidance of the related issues described above.

Figure 6:
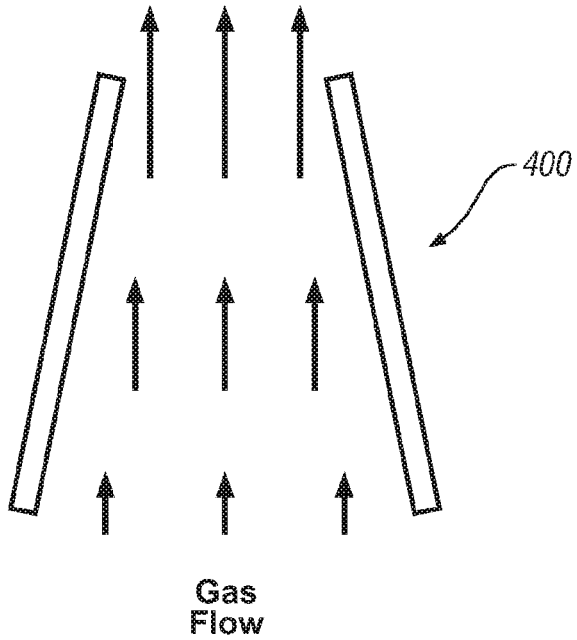
FIG. 6 depicts a schematic of a nozzle acting upon a gas flow in accordance with the present disclosure.

Fouling of an EGR cooler can be minimized by modulating EGR flow through the EGR cooler to maintain EGR flow velocities above a threshold level. As will be appreciated by one having ordinary skill in the art, gas flow velocity across a given length of travel for a gas flow depends upon the cross sectional area of the length. By choking down a cross section, the gas flow moving through the length with the choked cross section will increase in flow velocity. FIG. 6 illustrates a sectional view of an exemplary nozzle design, wherein the cross section through which a gas flow travels is choked down over the length of the nozzle, in accordance with the present disclosure. Average gas velocities for a cross section through nozzle 400 are represented by the length of the arrows depicted. As the cross section of the nozzle gets smaller as the walls converge, the velocity of the gas flow at that section, with all other variables held constant, increases. By choking or reducing the cross section of EGR flow moving through an EGR cooler, EGR flow velocities within the EGR cooler can be increased. Thus, by choking or modulating the cross section available within an EGR cooler, an EGR flow can be modulated to maintain a minimum EGR flow velocity. It should be noted that, with regard to any gas flow through a section, choking down the section results in higher flow resistance, reducing the overall flow rate (mass per unit of time) of the gas flow. In the context of choking flow through an EGR cooler, a reduction in EGR flow rate as compared to an unchoked EGR cooler must be compensated for to deliver a desired EGR flow rate to the combustion chamber.

Figure 7:
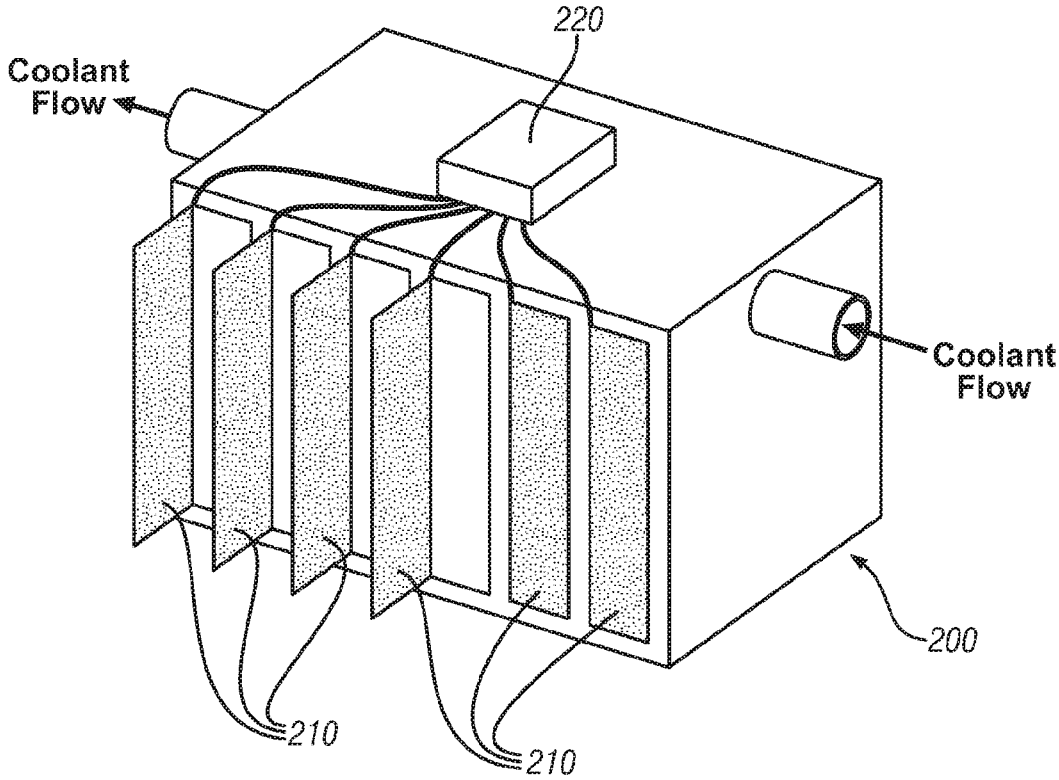
FIG. 7 illustrates a perspective view of a heat exchanger utilizing flow control doors in accordance with the present disclosure.

One exemplary method to decrease total gas flow cross section through a heat exchanger such as an EGR cooler can be accomplished by reducing the number of gas flow passages available for the EGR flow to flow through. FIG. 7 illustrates a perspective view of an exemplary EGR cooler in accordance with the present disclosure. EGR cooler 200 is depicted including flow control doors 210 and door actuator module 220. Flow control doors 210 are operative to individually open and close on command by control system 25 through door actuator module 220. Depending upon the particular design of the heat exchanger employed within the device, flow control doors 210 can be directly attached to corresponding gas flow passages of the heat exchanger, blocking or allowing EGR flow through the individual gas flow passages. Alternatively, flow control doors 210 can correspond directly to a group of gas flow passages; for instance, an individual door can cover a group of six tubes, incrementally opening or closing the tubes as a group. Alternatively, flow control doors 210 can be part of a separate housing or EGR cooler face cover, with each door opening covering a portion of the face of the heat exchanger. Such a configuration must still open and close gas passages in a step or binary manner, so as to avoid partially opened gas passages with lower EGR flow velocities. In the case of a separate housing or EGR cooler face cover holding flow control doors 210, especially if the doors are separated from the gas flow passage or tube openings, a gasketing device can be used to prevent EGR flow from spreading out at lower velocity to sections of the heat exchanger not directly corresponding to the door opening. Many embodiments of control doors 210 utilized in conjunction with the EGR cooler are envisioned, and the disclosure is not intended to be limited to the exemplary embodiments described herein. Control doors 210 employ sealing methods known in the art to prevent EGR flow from traveling past closed doors or passing from intended gas flow passages to unintended gas flow passages. Additionally, doors, gasketing devices, and any other components exposed to the gas flow must be constructed of materials capable of withstanding the temperatures and corrosive forces within the gas flow, as described above in relation to heat exchangers. Door actuator module 220 is depicted as a single unit with control means directed to each individual flow control door 210. Door actuator module 220 and the particular method that the module employs to control the various flow control doors can take many forms. For example, door actuator module 220 can utilize a single electronic motor with an output shaft attached to a gear set or a cam device. Such gear sets and cam devices are known in the art and can translate a single rotational input into incremental door movements. Alternatively, door control module 220 can comprise a control module attached to individual electrical actuators attached to each door, the control module sending controlling electric signals to each actuator to effect open and close commands. Alternatively, door control module 220 can include individual electrical actuators attached to each door receiving commands directly from control system 25. Many embodiments of control methods to actuate flow control doors 210 are envisioned, and the disclosure is not intended to be limited to the exemplary embodiments described herein. By closing a portion of the flow control doors 210, EGR flow can be restricted to a portion of the gas flow passages within the EGR cooler, thereby reducing the cross section through which the EGR flow passes within the heat exchanger and increasing resulting the EGR flow velocities within the EGR cooler.

The configuration of flow control doors illustrated shows a plurality of doors, each covering a portion of the heat exchanger, and all of the doors together have the ability to close off the entire heat exchanger. With regard to EGR circuits, it should be noted that for certain EGR coolers with particular EGR circuit operating requirements, it may be sufficient to simply use a door or doors to close off a portion of the heat exchanger, for example utilizing one door to close off a third of the heat exchanger and another door to close off another fourth of the heat exchanger. Such a configuration, as determined by modeling, experimentation, testing, or analysis, can for specific vehicular requirements be sufficient to ensure a minimum EGR flow velocity within the EGR cooler throughout the range of engine and vehicle operation without the doors having the ability to shut off the entire gas flow to the heat exchanger.

Figure 8:
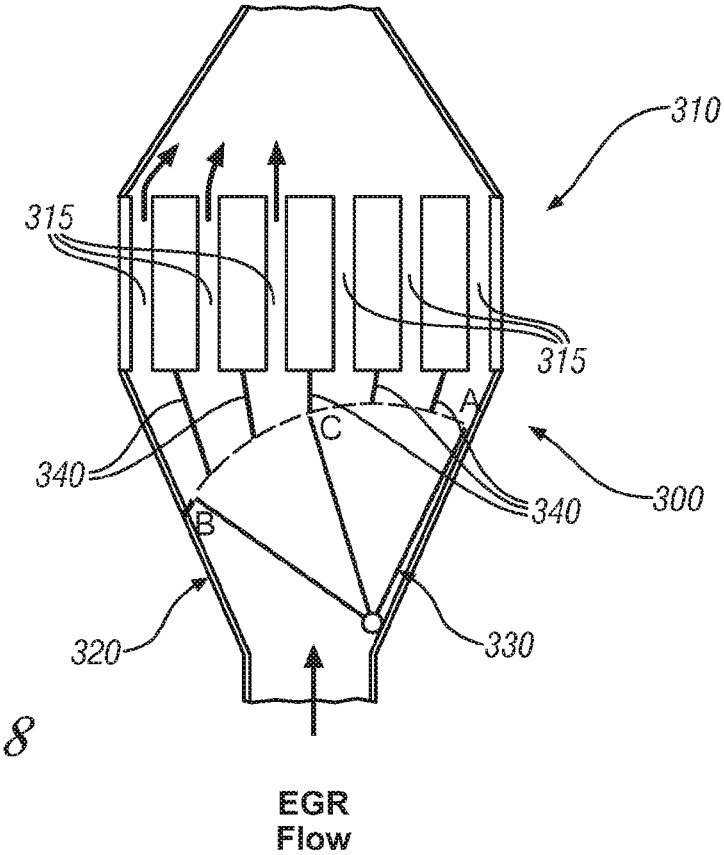
FIG. 8 depicts a schematic of a heat exchanger utilizing a flow control door within a plenum assembly in accordance with the present disclosure.

FIG. 8 illustrates a sectional view of another exemplary EGR cooler in accordance with the present disclosure. EGR cooler 300 is depicted comprising heat exchanger 310 and plenum assembly 320. Heat exchanger 310 is depicted with several tubes 315. Plenum assembly 320 includes flow control door 330 and flow directors 340. In the exemplary embodiment, flow control door 330 comprises a single panel door with a fixed axis and is depicted with three exemplary door locations A, B, and C. Door position A corresponds to a fully open door position, allowing EGR flow through the entire heat exchanger 310. Door position B corresponds to a fully closed door position, restricting EGR flow in its entirety from passing through heat exchanger 310. It will be appreciated by one having ordinary skill in the art that any embodiment with a flow control door or doors enabling the EGR cooler to be entirely closed off can be used as a backup or replacement to an EGR valve. Door position C corresponds to a partially open door position, restricting EGR flow through a portion of heat exchanger 310 and allowing EGR flow through flow through the remaining portion of heat exchanger 310. Plenum assembly 320 and any door mechanisms with include sealing strategies known in the art to direct gas flow and prevent substantial gas flow through unintended flow paths. Such sealing methods are also employed at the interface between plenum assembly 320 and heat exchanger 310, preventing any EGR flow from leaking past gas flow passages through which the flow is intended to travel. Door designs controlling gas flow are known in the art, and can take many forms, including but not limited to panel doors, butterfly doors, and barrel-type doors. Additionally, flow control door 330 can be replaced with a pair of doors or multiple doors accomplishing the same EGR flow control properties of the single door. Although exemplary embodiments of the control door or doors have been described, multiple configurations are contemplated and the disclosure is not intended to be limited to the specific exemplary embodiments described herein. By closing a portion of the gas flow passages of heat exchanger 310, EGR flow can be restricted to a portion of the gas flow passages within the EGR cooler, thereby reducing the cross section through which the EGR flow passes within the heat exchanger and increasing resulting the EGR flow velocities within the EGR cooler.

Regardless of the control door design utilized, a control method to determine the state of the control door or doors must include a measure of the expected EGR flow velocities within the EGR cooler. One exemplary method to estimate the EGR flow velocities within the EGR cooler is to monitor the exhaust system, either directly or by inference through monitoring the engine, and utilize the state of the exhaust gas flow in coordination with the state of the EGR valve to infer EGR flow velocities either through lookup tables or through a processor utilizing an algorithm. Another exemplary method to estimate the EGR flow velocities within the EGR cooler is to monitor EGR flow rate through some section of the EGR circuit through a gas flow meter. Gas flow meters are known in the art and will not be described in detail herein. Once an EGR gas flow is determined, EGR flow velocities within the EGR cooler can be estimated through either lookup tables of through a processor utilizing an algorithm. Many methods to estimate the EGR flow velocities within the EGR cooler are contemplated, and the disclosure is not intended to be limited to the specific exemplary embodiments described herein. Once determined EGR flow velocities within the EGR cooler are estimated or inferred, the value or values may be compared to a minimum threshold EGR flow velocity selected based on fouling rates. If the determined EGR flow velocities are below the minimum threshold EGR flow velocity, then door controls are activated to reduce the cross section of heat exchanger utilized within the EGR cooler. If the determined EGR flow velocities are above the minimum threshold EGR flow velocity by more than an increment or are above a maximum threshold EGR flow velocity, then door controls are activated to increase the cross section of heat exchanger utilized within the EGR cooler. Values for a minimum threshold EGR flow velocity, a maximum threshold EGR flow velocity, or other operative variables may be developed experimentally, empirically, predictively, through modeling or other techniques adequate to accurately predict vehicle, engine, and EGR operation.

The above methods describe the utilization of flow control doors to incrementally block flow through a portion of a heat exchanger to minimize fouling within the heat exchanger. Additionally, the flow control doors described in the exemplary embodiments utilize doors in front or upstream of the heat exchanger to block gas flow. However, it will be appreciated by one having ordinary skill in the art that many methods are known for blocking gas flows. For example, a sliding plate could incrementally be moved or translated in front of the heat exchanger to block off portions of the heat exchanger from gas flow. Additionally, doors or other devices could block flow from exiting the back or downstream exit sections of the heat exchanger, utilizing back pressure in the blocked tubes to prevent gas flow from entering the tubes. Many alternative designs for preventing gas from flowing through a portion of a heat exchanger are contemplated, and the disclosure is not intended to be limited to the exemplary embodiments described herein.

Figure 9:
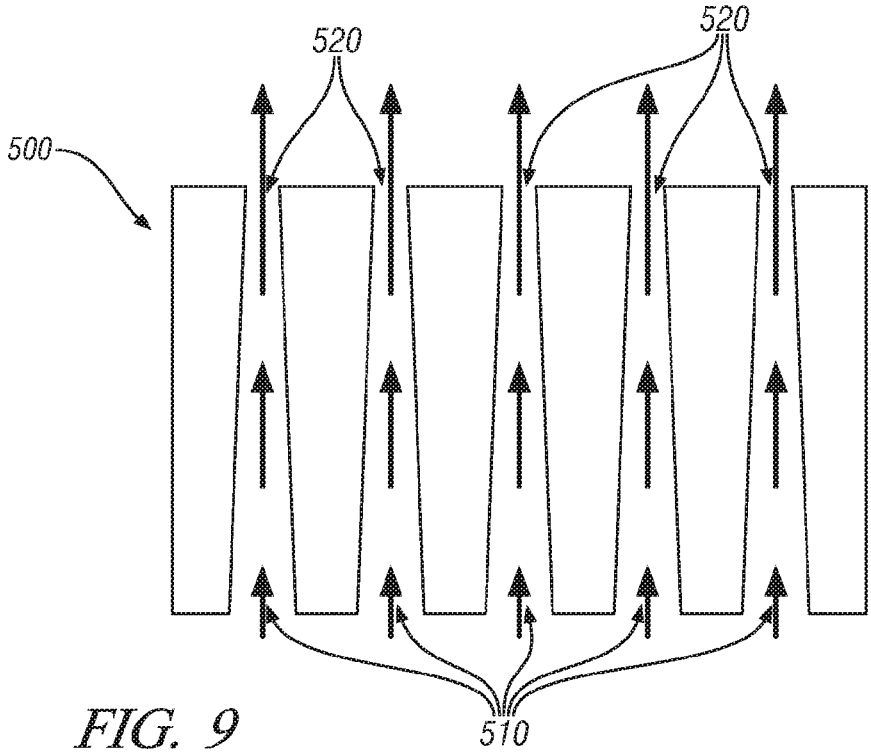
FIG. 9 depicts a schematic of a heat exchanger utilizing tapered flow passages in an absence of heat exchange in accordance with the present disclosure.

While a gas flow rate (mass per unit time) through a length of travel for a given gas flow remains constant, changes to density of the gas within the gas flow can change the velocity of the gas flow through the length of travel. For example, if a gas flow contains one kilogram of air per second traveling through an entrance to a tube at 100 degree Celsius and the gas cools over the length of the tube to 20 degrees Celsius, the volume that the one kilogram will occupy with all other factors constant will be smaller at the exit than at the entrance. Similarly, EGR flow traveling through the EGR cooler, experiencing a reduction in temperature, will be more dense at the exit of the EGR cooler than at the entrance. Therefore, an EGR flow exhibiting velocities successfully avoiding excessive fouling at the entrance to the EGR cooler can slow through the length of the gas flow passages to an EGR flow velocity wherein excessive fouling is more likely. The method described above, preventing fouling in an EGR cooler by maintaining a minimum gas flow rate within the EGR cooler, can be implemented by adjusting the geometry of gas flow passages to choke down on the gas flow traveling therethrough. In this way, an EGR circuit designed to provide at least a minimum EGR flow velocity at the entrance to the EGR cooler will not experience fouling at the exits of the EGR cooler due to the effects of cooling upon the EGR flow. FIG. 9 illustrates an exemplary heat exchanger configuration including tubes with gradually reduced cross sections, operating with no heat transfer from the gas flow, in accordance with the disclosure. Heat exchanger 500 is depicted showing tubes with a tapered or nozzle-like design. The tubes of the illustrated exemplary heat exchanger include with relatively wide entrances 510 and relatively narrow exits 520. The resulting tapering though the tubes can be designed for each particular application, taking into account the expected changes in EGR flow density though the length of the heat exchanger. Alternatively, heat exchangers utilizing tubes to transport the cooling medium can similarly utilize tapered gas flow passages. Many heat exchanger configurations are contemplated that result in tapered or nozzled designs, and the disclosure is not intended to limited to the specific exemplary embodiments described herein.

Figure 10:
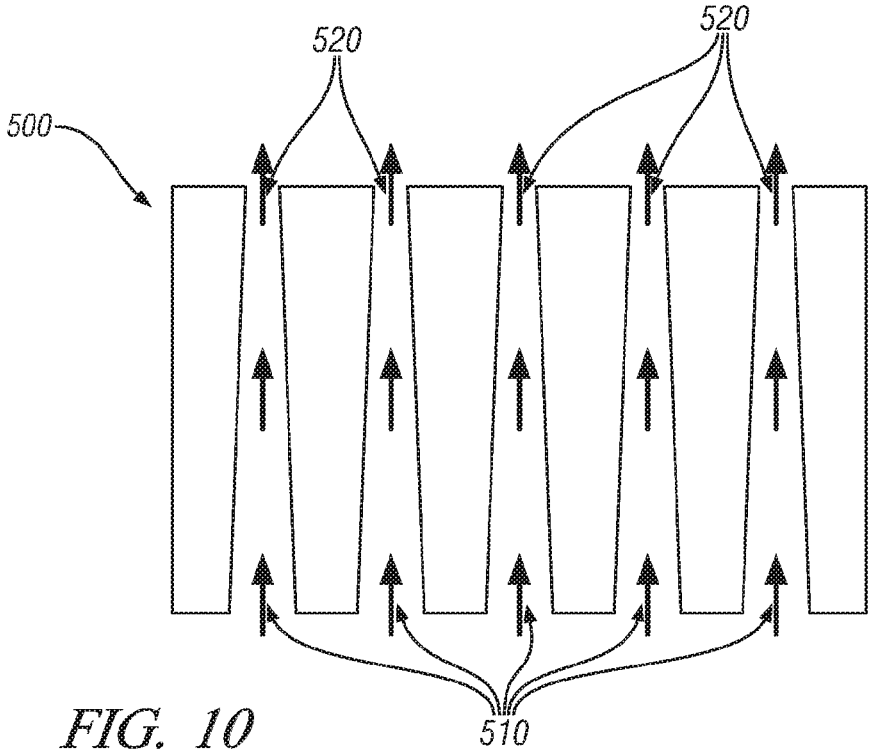
FIG. 10 depicts a schematic of a heat exchanger utilizing tapered flow passages in a presence of heat exchange in accordance with the present disclosure.

As mentioned above, FIG. 9 illustrates an exemplary heat exchanger configuration including tubes with gradually reduced cross sections, operating with no heat transfer from the gas flow. Because no heat transfer is occurring, the temperature of the gas flow and the resulting density of the gas flow remain unchanged. As a result, the average flow velocities for various sections of the gas flow through the heat exchanger, as represented by the length of the arrows depicted, increases through the length of the heat exchanger. This increase in flow velocities is consistent with results that would be expected from the exemplary nozzle described in FIG. 7. However, once the heat exchanger is operated to remove heat from the gas flow, the temperature of the gas flow through the length of the heat exchanger reduces. This reduction in temperature results in an increase in density in the gas flow as described above. FIG. 10 illustrates a exemplary heat exchanger configuration including tubes with gradually reduced cross sections, operating with heat transfer from the gas flow, in accordance with the disclosure. The heat exchanger 500 and the associated tubes depicted in FIG. 9 are also pictured in FIG. 10. Because the tapered tubes as described above act to increase the flow velocity of the gas flow, the resulting decrease in velocity from the cooling of the gas flow and the corresponding increase in gas flow density as described above is substantially offset. As a result, the average flow velocities for various sections of the gas flow through the heat exchanger, as represented by the length of the arrows depicted, remains substantially constant through the length of the heat exchanger. It should be noted that many of the variables involved in the heat transfer, including the gas flow properties, the coolant flow properties, and the state of the heat exchanger, will change and affect the resulting flow velocities resulting in various locations within the heat exchanger. As a result, the flow velocities will tend to vary at different locations within the heat exchanger depending upon operating conditions; however, the tapered design of the heat exchanger greatly reduces the variability of the average flow velocities through the length of the heat exchanger due to increasing density of the gas flow. Applied to EGR coolers, the amount of tapering to be used in a particular heat exchanger may be developed experimentally, empirically, predictively, through modeling or other techniques adequate to accurately predict EGR operation.

The tapered tubes illustrated in FIG. 10 depict gas flows resulting in consistent or nearly consistent gas flow velocities throughout the length of the tubes. As will be appreciated by one having ordinary skill in the art, different velocity profiles within the tubes can be advantageous for reasons outside of fouling. Additionally, testing has shown that lower temperatures also result in increased fouling, so it can be advantageous to include extra taper in the heat exchanger, increasing gas flow velocities further as the gas flow cools to compensate for the temperature effect. The particular velocity profile of gas flowing through the tubes can be controlled by the amount of tapering utilized in the tubes, and such designs can utilize a minimum gas flow velocity as described in the methods herein by calculating or estimating the gas flow velocities of the gas at the least tapered section of the heat exchanger and comparing these gas flow velocities to a minimum gas flow velocity required to avoid fouling.

Figure 11:
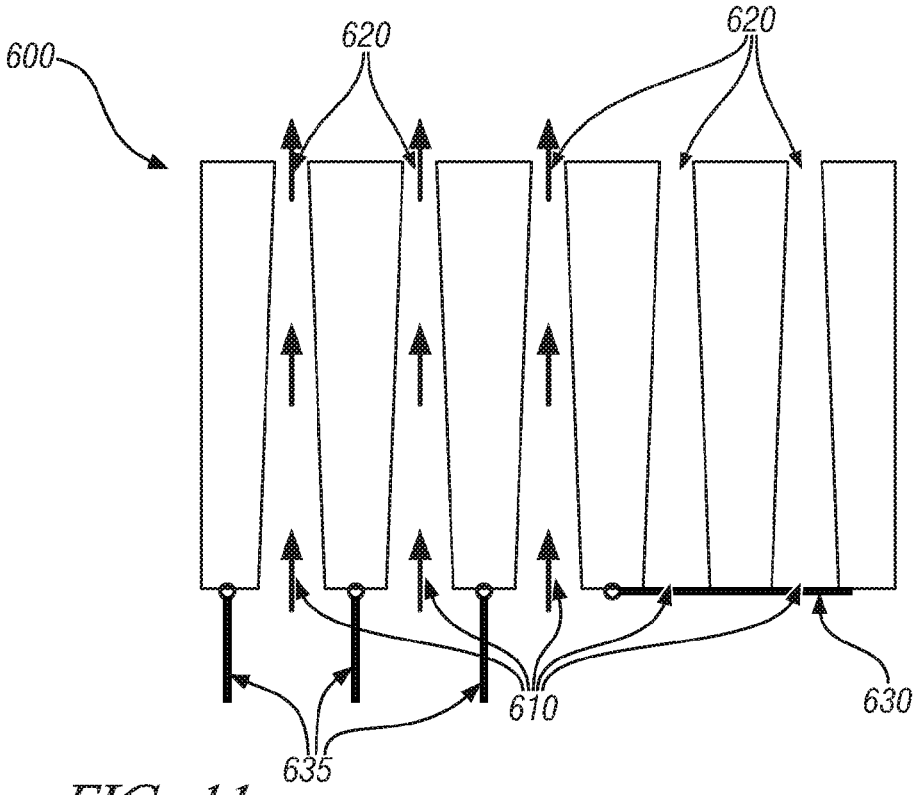
FIG. 11 depicts a schematic of a heat exchanger utilizing tapered flow passages in an absence of heat exchange and flow control doors in accordance with the present disclosure.

The tapering of gas flow passages within a heat exchanger can solely reduce combustion by-product build-up within an EGR cooler. Depending upon the particular engine and EGR circuit design, the EGR flow velocities within the EGR cooler may maintain a minimum threshold EGR flow velocity without the use of flow control doors, and the implementation of tapered gas flow passages can reduce fouling as a stand alone improvement. However, flow control doors as described above can be used in conjunction with a tapered heat exchanger design as described above in designs where a minimum threshold EGR flow velocity cannot be maintained through the range of engine operation. Additionally, it will be appreciated by one having ordinary skill in the art that utilizing a tapered tube design in conjunction with flow control doors allows the use of a lower minimum threshold EGR flow velocity to activate the flow control doors, as the tapered gas flow passages increase the lowest sectional average EGR flow velocity experienced in a given EGR cooler by compensating for reduced EGR flow density. FIG. 11 illustrates an exemplary embodiment utilizing flow control doors and an exemplary heat exchanger configuration including tubes with gradually reduced cross sections, operating with heat transfer from the gas flow, in accordance with the disclosure. Heat exchanger 600 is depicted including tubes with relatively wide entrances 610 and relatively narrow exits 620. Additionally, heat exchanger 600 is depicted including flow control doors 630 and 635. As depicted in FIG. 11, doors of different sizes may be used, depending upon gas flows expected in the heat exchangers and the control methodology selected. Applied to an EGR circuit, by using flow control doors in combination with tapered tubes, a minimum EGR flow velocity can be maintained at varying EGR flow rates through activation of the control doors, and changes in gas density resulting from heat exchange can be compensated for, both beneficial results accruing in the same heat exchanger.

As aforementioned, particular embodiments of heat exchanger applications include utilizing sequential heat exchangers, a plurality of heat exchangers in parallel, or a combination thereof. The aforementioned methods to maintain minimum gas flow velocities to minimize fouling can be utilized in sequential heat exchanger designs. The sequential heat exchangers may or may not be of similar types and configurations. The above methods, describing the use of flow control doors to block a portion of the gas flow passages or tubes available to the gas flow and tapering the gas flows to account for changing density, can be applied to sequential heat exchangers by maintaining gas flow cross-sectional designs between the heat exchangers and avoiding gas from flowing through unintended passages through sealing or gasketing as described above. For example, if a first heat exchanger without tapered tubes, with a certain door configuration controlled to close particular doors, results in a total open tube cross section of 100 $cm^2$, then tubes of the second heat exchanger sealed to the open tubes of the first heat exchanger, should have no more than 100 $cm^2$ of total open tube cross section to maintain the minimum gas flow velocity. Similarly, if a first heat exchanger includes tapered tubes designed to take the change in density of the gas flow into account, tapering the total open tube cross section over the length of the tubes as described above, then tubes of the second heat exchanger sealed to the open tubes of the first heat exchanger should continue a similarly designed rate of tapering of the total open tube cross section. In either of the above examples, heat exchangers with different numbers and sizes of tubes or gas flow passages can be joined and thus, per the examples, utilize the methods described herein, although one having ordinary skill in the art will appreciate that gas flow velocity in a cross section close to a wall is not the same as gas flow velocity in the center of a cross section, so therefore transition to or from smaller tubes or gas flow passages will require an adjustment factor to compensate for gas flow losses associated with the effects of the greater interaction with the walls. This adjustment factor may be developed experimentally, empirically, predictively, through modeling or other techniques adequate to accurately predict gas flow velocities in heat exchangers. As mentioned above, the gas flow between the heat exchangers must not be allowed to leak into unintended gas flow paths, wherein the gas flow velocities would decrease and fouling would result. Seals or gaskets can be used between the heat exchangers to maintain the intended gas flow paths. Alternatively, the heat exchangers could be designed to fit together, with tubes from one heat exchanger being designed to fit into corresponding openings in the other heat exchanger. Alternatively, the heat exchangers could be of unitary design, with distinct medium flows traveling through the same heat exchanger. By utilizing a consistent total tube cross section strategy, either methods utilizing flow control doors or tapered gas flow passages or tubes can be utilized in sequential heat exchangers to minimize fouling within the heat exchangers.

Figure 12:
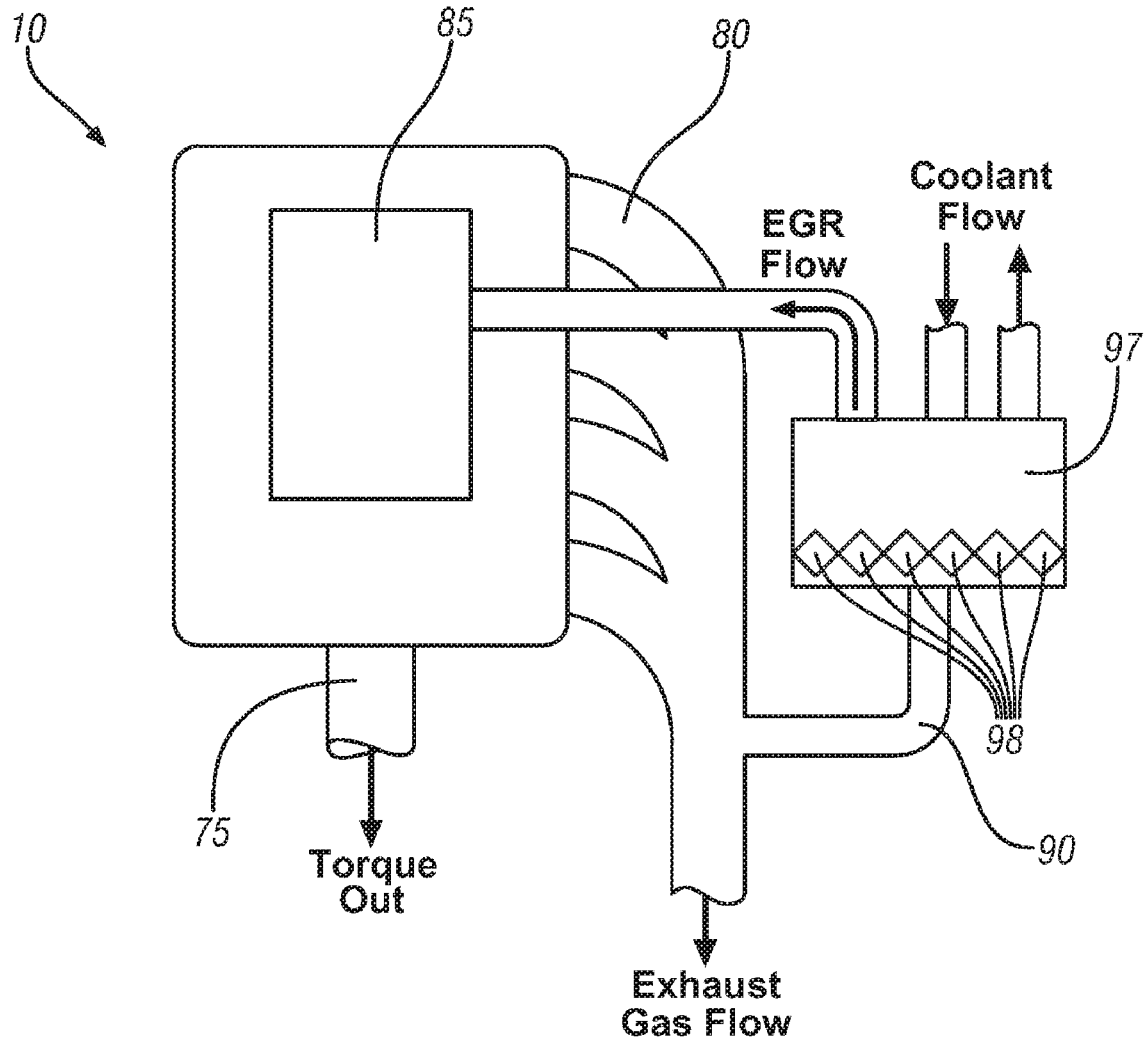
FIG. 12 depicts a schematic of an engine utilizing an EGR circuit including flow control doors capable of fully closing off EGR flow, thereby eliminating need for an EGR valve, in accordance with the present disclosure.

As mentioned above, a flow control door or doors can be utilized to replace the functions of an EGR valve. FIG. 12 schematically illustrates an exemplary engine configuration utilizing an EGR circuit in accordance with the present disclosure. Engine 10 is depicted including an exhaust system 80, an intake manifold 85, and an EGR circuit 90. EGR circuit 90 is communicably attached to exhaust system 80 and is depicted including an EGR cooler 97 and flow control doors 98. Flow control doors 98 are activated based upon EGR control methodology and EGR flow velocity concerns as describe above. The EGR valve described in previous embodiments is no longer necessary. Flow control doors 98, when controlled to an off position, block any exhaust gas flow from exhaust system 80 from flowing EGR circuit 90. Although the flow control doors are not located at the entrance to the EGR circuit as the EGR valve was depicted in FIG. 1, one having ordinary skill in the art will appreciate that closing flow control doors 98 will create back pressure within the upstream portions of EGR circuit 90, having the same effect as a closed EGR valve.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method to reduce combustion by-product deposit build-up within a heat exchanger of a motor vehicle, wherein said heat exchanger processes a gas flow including exhaust gas, by maintaining a minimum exhaust gas recirculation flow velocity within the heat exchanger, the method comprising:

determining the minimum exhaust gas recirculation flow velocity selected based on avoiding excessive fouling rates;

reducing a heat exchanger total gas flow cross section to locally increase an exhaust gas recirculation flow velocity, the locally increased exhaust gas recirculation flow velocity maintains the minimum exhaust gas recirculation flow velocity by offsetting decreases in exhaust gas recirculation flow velocity resulting from cooling of the exhaust gas recirculation flow through the length of the heat exchanger; and wherein the exhaust gas recirculation flow comprises a diverted portion of an exhaust gas flow utilized for controlling combustion within a combustion chamber.

2. The method of claim 1, wherein said reducing is performed within an exhaust gas recirculation cooler.

3. The method of claim 1, wherein said reducing comprises selectively blocking a portion of a total heat exchanger cross section, thereby allowing an exhaust gas recirculation flow to flow only through an unblocked portion of said heat exchanger.

4. The method of claim 3, wherein said selectively blocking comprises:

operating a plurality of flow control doors in close proximity to said heat exchanger, wherein each of said flow control doors when closed blocks a different portion of said heat exchanger; and controlling said flow control doors based on said estimated exhaust gas recirculation flow rate, wherein said controlling said flow control doors comprises:

monitoring exhaust gas recirculation flow velocity within said heat exchanger; and closing at least one of said flow control doors if said exhaust gas recirculation flow velocity is less than a first predetermined exhaust gas recirculation flow velocity.

5. The method of claim 4, wherein controlling said flow control doors based on said estimated exhaust gas recirculation flow rate further comprises opening at least one of said flow control doors if said exhaust gas recirculation flow velocity is greater than a second predetermined exhaust gas recirculation flow velocity.

6. The method of claim 4, wherein said operating a plurality of flow control doors in close proximity to said heat exchanger comprises directly connecting said flow control doors to said heat exchanger.

7. The method of claim 4, wherein said operating a plurality of flow control doors in close proximity to said heat exchanger comprises connecting said flow control doors to a face of said heat exchanger with a gasketing device operating to separate said portion selectively blocked from a remaining portion of said heat exchanger.

8. The method of claim 4, wherein said reducing a heat exchanger total gas flow cross section further comprises providing gas flow passages having progressively reduced cross sectional area in the direction of exhaust gas recirculation flow.

9. The method of claim 3, wherein said selectively blocking comprises:

operating a plenum assembly in close proximity to said heat exchanger, wherein said plenum assembly includes at least one flow control door and internal passages selectively directing said exhaust gas recirculation flow away from said portion selectively blocked;

determining an exhaust gas recirculation flow velocity for said exhaust gas recirculation flow in said heat exchanger; and controlling said flow control door by incrementally closing at least one of said internal passages by articulating said flow control door if exhaust gas recirculation flow velocity is less than a first predetermined exhaust gas recirculation flow velocity.

10. The method of claim 9, wherein said controlling said flow control door further comprises opening at least one of said internal passages by articulating said flow control door if exhaust gas recirculation flow velocity is greater than a second predetermined exhaust gas recirculation flow velocity.

11. The method of claim 9, wherein said reducing a heat exchanger total gas flow cross section further comprises providing gas flow passages having progressively reduced cross sectional area in the direction of exhaust gas recirculation flow.

12. The method of claim 1, wherein said reducing a heat exchanger total gas flow cross section further comprises providing gas flow passages having progressively reduced cross sectional area in the direction of exhaust gas recirculation flow.

13. The method of claim 12, wherein said progressively reduced cross sectional area effects a substantially uniform average exhaust gas recirculation flow velocity through said gas flow passages based upon an average rate of heat transfer within said heat exchanger.

14. The method of claim 12, wherein said progressively reduced cross sectional area effects a substantially uniform average exhaust gas recirculation flow velocity through said gas flow passages based upon a maximum rate of heat transfer within said heat exchanger.

15. The method of claim 12, wherein said progressively reduced cross sectional area effects an accelerating average exhaust gas recirculation flow velocity through said gas flow passages based upon an average rate of heat transfer within said heat exchanger.

16. Apparatus for reducing combustion by-product deposit build-up within a heat exchanger of a motor vehicle, wherein said heat exchanger processes an exhaust gas recirculation flow including exhaust gas, comprising:

a plurality of gas flow passages within said heat exchanger, said gas flow passages comprise tapered gas flow passages with gradually reducing cross sections in the direction of gas flow increasing the resulting exhaust gas recirculation flow velocity within said heat exchanger;

a flow control door operating in close proximity to said heat exchanger and selectively blocking a portion of said heat exchanger, such that exhaust gas recirculation flow is blocked from flowing through said portion in a substantially binary manner thereby reducing the cross section of the heat exchanger through which the exhaust as recirculation flow passes within said heat exchanger and increasing the resulting exhaust gas recirculation flow velocity within said heat exchanger;

an actuator for controlling said flow control door; and wherein increasing the resulting exhaust gas recirculation flow velocity within said heat exchanger maintains a minimum exhaust gas recirculation flow velocity selected based on avoiding excessive fouling rates and said tapered gas flow passages with gradually reducing cross sections offsets decreases in exhaust gas recirculation flow velocity resulting from cooling of the exhaust gas recirculation flow through the length of said plurality of gas flow passages within said heat exchanger;

wherein the exhaust gas recirculation flow comprises a diverted portion of an exhaust gas flow utilized for controlling combustion within a combustion chamber.

17. The apparatus of claim 16, further comprising a plurality of flow control doors, each operating in close proximity to said heat exchanger and selectively blocking a respective portion of said heat exchanger, such that exhaust gas recirculation flow is incrementally blocked from flowing through each respective portion in a substantially binary manner.

18. Apparatus for reducing combustion by-product deposit build-up within a heat exchanger of a motor vehicle, wherein said heat exchanger processes a gas flow including exhaust gas, comprising:

said heat exchanger including a plurality of gas flow passages, wherein said gas flow passages comprise tapered gas flow passages with gradually reducing cross sections in the direction of gas flow, said tapered gas flow passages each comprising a gas flow entrance wider than a respective gas flow exit.

* * * * *